United States Patent [19]

King

[11] 4,382,721

[45] May 10, 1983

[54] MINE ROADWAY SUPPORT STILT

[75] Inventor: Norman S. King, Newcastle-Upon-Tyne, England

[73] Assignee: Holywell Engineering Limited, England

[21] Appl. No.: 279,403

[22] Filed: Jul. 1, 1981

Related U.S. Application Data

[63] Continuation of Ser. No. 57,583, Jul. 16, 1979, abandoned.

[51] Int. Cl.[3] ..... E21D 11/00

[52] U.S. Cl. ..... 405/288; 248/356; 405/303

[58] Field of Search ..... 405/288, 290, 303, 291; 248/356

[56] References Cited

U.S. PATENT DOCUMENTS

| | | | |
|---|---|---|---|
| 785,455 | 3/1905 | Vigie | 248/356 X |
| 3,033,509 | 5/1962 | Carlson | 248/356 |

FOREIGN PATENT DOCUMENTS

| | | | |
|---|---|---|---|
| B32650 | 5/1956 | Fed. Rep. of Germany | 248/356 |
| 1909470 | 9/1970 | Fed. Rep. of Germany | 248/356 |
| 966592 | 8/1964 | United Kingdom | 248/356 |
| 1247348 | 9/1971 | United Kingdom | 248/356 |

*Primary Examiner*—Dennis L. Taylor
*Attorney, Agent, or Firm*—R. Gale Rhodes, Jr.

[57] ABSTRACT

A mine roadway support stilt includes, on two opposing faces thereof, a plurality of deformable, longitudinally extending indentations and, on the remaining faces, additional indentations to inhibit improper insertion of the I-beam joist support normally received in said stilt.

1 Claim, 4 Drawing Figures

ISOMETRIC VIEW

PLAN VIEW

SIDE ELEVATION

FRONT ELEVATION

ISOMETRIC VIEW

MINE ROADWAY SUPPORT STILT

This is a continuation of application Ser. No. 57,583, filed July 16, 1979, now abandoned.

BACKGROUND OF THE INVENTION (a) Field of the Invention

Broadly speaking, this invention relates to subterranean roadway supports. More particularly, in a preferred embodiment, this invention relates to an improved stilt for receiving an I-beam joist support.

(b) Discussion of the Prior Art

During the mining of subterranean minerals, it is frequently necessary to construct roads or railways from the mine entrance to the point of mineral production. The roads may be driven within the mineral vein itself or in the strata above or below the vein. Where the vein is not of the required height, additional elevation may be obtained by excavating some of the roof or floor strata.

The extraction of the mineral or the excavation of the surrounding strata during construction of the road, will, in general, disturb the equilibrium of the stresses in the surrounding strata. The supports which are typically erected to prevent the collapse of the roof, or lateral movement of the sides of the road, must therefore incorporate in their design components to allow for the initial rapid strata movement—both vertical and lateral—which typically occurs while the region is consolidating itself.

Ideally, the aforementioned components continue to take up strata movement throughout the consolidation period such that at the end of this period the foot of the support leg will be touching the floor, thus offering maximum resistance to any further strata movement.

The form taken by these supports typically comprises at least two vertical, or nearly vertical, legs, usually a rolled steel I-beam joist, which hold a roof beam in contact with the roof of the mine road. Alternatively, the supports may comprise two or more curved I-beams which are coupled together in an arch profile, the lower extremities of the arch acting as legs, while the upper curve of the arch contacts the roof of the road.

The components which are attached to the support legs to control the rate of yield are known in the industry as stilts. One particular form of stilt comprises a rectangular steel tube, the dimensions of which are chosen to allow the support leg to enter therein. The lower section of the tube is provided with longitudinal indentations on opposing faces of the tube. The indentations protrude into the tube with their upper face being angled to allow the leg of the support to enter the stilt in a gradual manner. Vertical strata pressure forces the support leg downward deforming the indentations and thereby absorbing a certan amount of the strata pressure and so controlling the yielding support legs.

In order to resist lateral strata movement, it is usual to erect the support legs such that they are inclined at the top, i.e. into the roadway, the angle of this inclination being 5 degrees from the vertical. In addition, if the floor of the roadway is soft, the stilt will tend to penetrate the floor when the support is under load from the overlaying strata, before the stilt reaches its designed yield load. In such conditions, it is usual to attach a base plate to the support which has an area of floor contact which is sufficient to prevent this penetration from happening.

Such stilts and base plates are well known in the mining industry but suffer from several disadvantages. More specifically, in the prior art devices: (1) The flanges of the I-beam support legs must come into contact with the aforementioned indentations if the stilt is to perform its designed function, but, if by error the support leg is placed into the stilt the wrong way round, i.e. rotated through an angle of 90 degrees, the support leg will not make the necessary contact with the stilt indentations and is, thus, rendered ineffective; (2) The upper section of the tube has no yielding indentations and is thus able to accept the insertion of the support leg; however, the length of this entry section is critical in that it provides the required rigidity to prevent lateral displacement of either the stilt or the support leg before yielding commences and the prior art devices do not satisfy this criticality; (3) the angle formed by the upper receiving face of the indentations is likewise critical; if the angle is too large, it will cause the initial yield rate to be erratic, with consequent load shedding of the supports with possible damage to a friable roof strata. On the other hand, if the abovementioned angle is too small, the initial rate of yield will be so rapid that valuable yielding distance will be lost, plus damage to the mine roadway roof.

SUMMARY OF THE INVENTION

As a solution to these and other problems, the present invention comprises a stilt which is fitted to the leg member of a mine roadway support to control the rate at which the support yields, prevent the wrongful insertion of the I-beam support member, provide sufficient tubular overlap between the upper section of the stilt and the support member to insure rigidity against lateral strata movements; and an initial yielding action which will be smooth and positive, thus overcoming the problems of load-shedding with consequent damage to friable roofs.

In order that the invention may be more fully understood, a preferred embodiment thereof will now be described, by way of example only, with reference to the accompanying drawings in which:

DETAILED DESCRIPTION OF THE INVENTION

Figure 3:
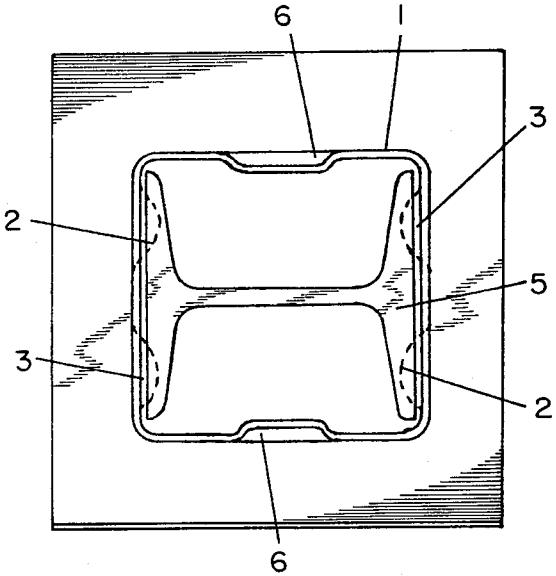
FIG. 3 is a plan view of the apparatus shown in FIGS. 1 and 2.
Figure 2:
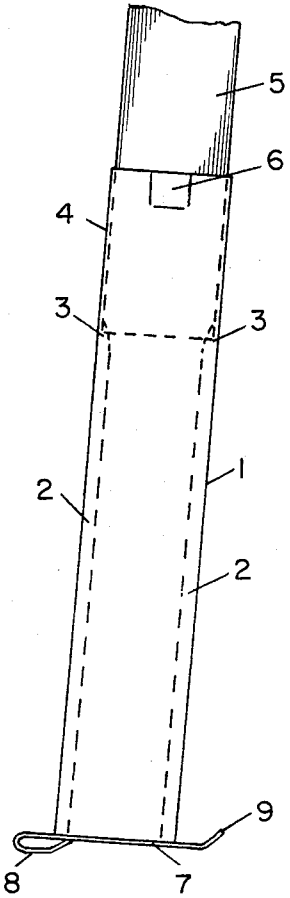
FIG. 2 is a side elevational view of the apparatus shown in FIG. 1.
Figure 1:
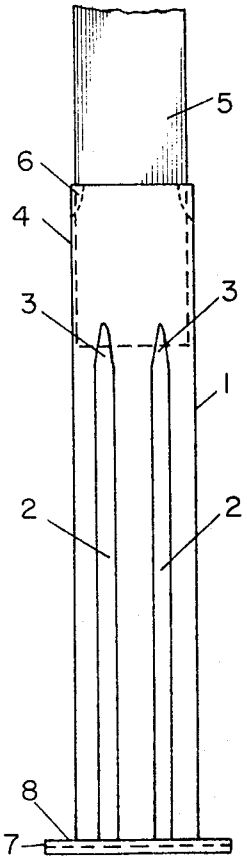
FIG. 1 is a front elevational view of an illustrative embodiment of the invention showing the support member inserted therein.
Figure 4:
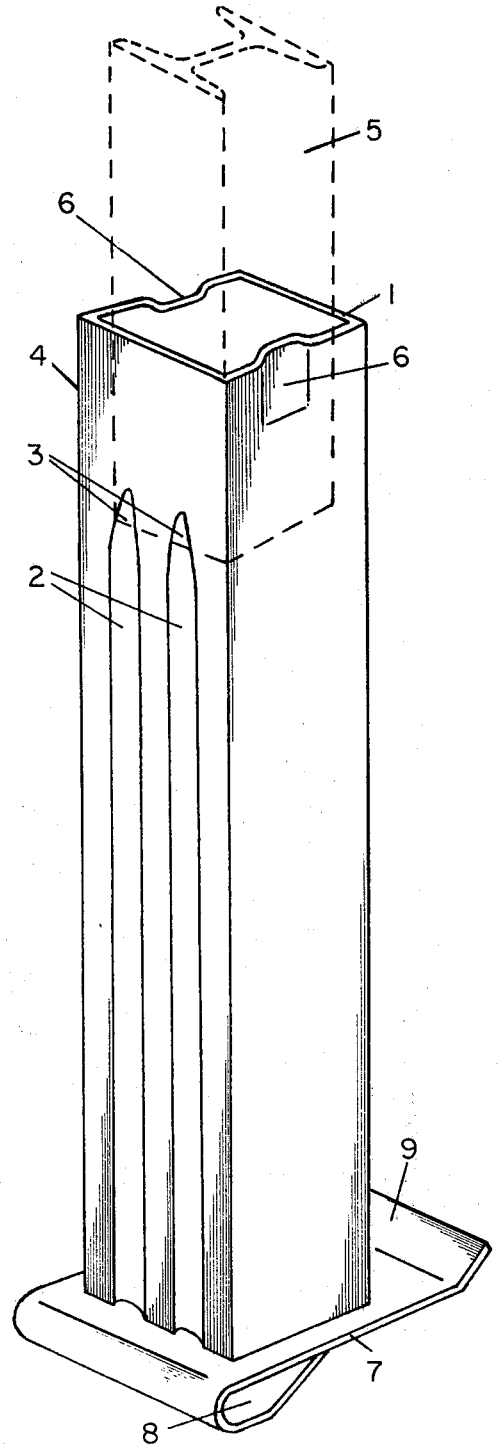
FIG. 4 is an isometric view of the apparatus shown in FIG. 1 with a portion of the support member shown in dashed outline.

As shown in FIGS. 1 and 2, an illustrative embodiment of the invention comprises a steel tube 1 of square or rectangular cross-section. Tube 1 has a plurality of longitudinal indentations 2, on two opposing faces, which extend over the major portion of its length. The upper ends of indentations 2 have an inclined surface 3 which slopes inwards at a gradual angle which may vary between $3\frac{1}{4}$ to 5 degrees from the vertical. The upper end 4 of tube 1 has no indentations on the two opposing faces which have the indentations 2. The length of this portion of the tube is, for example, 4 inches and will, thus, allow entry of the I-beam 5, maintaining the alignment thereof. The foot of I-beam 5 rests on the inclined surface 3 and deforms the indentations 2 when forced into the tube by the vertical strata pressure.

The upper end of tube 1 has an impression 6 formed on each of the two remaining opposing sides, i.e. the sides without the indentations 2, such as to prevent improper insertion of I-beam 5. Put another way, the flanges of the I-beam can only enter the tube on the sides having the indentations 2.

The steel tube 1 advantageously includes a plate 7 attached to its base to provide the required angle of inclination. The rear edge of plate 7 is bent backwards, through an obtuse angle, under the body of the plate to form an elevated heel 8, while the leading edge of the plate is angled upward to provide a lip or ridge 9 to prevent dislodgement of the tube.

One skilled in the art may make various changes and substitutions to the layout of parts shown without departing from the spirit and scope of the invention.

What is claimed is:

1. A mine roadway support stilt for use with an I-beam joist support, said roadway experiencing lateral strata movement, which comprises:

a hollow steel tube of generally rectangular section dimensioned to permit the longitudinal insertion therein of said joist support;

a plurality of longitudinally inwardly extending indentations on two opposing faces of said tube, said indentations being deformed by said joist as said joist is forced downwardly into said tube by external force, said longitudinally extending indentations extending from the bottom of said tube to within a predetermined distance from the top of said tube thereby to provide overlap between said tube and said inserted joist support so as to provide sufficient rigidity therebetween to prevent lateral displacement of said stilt or said joist support before deformation of said longitudinally extending indentations commences, and the upper end of each longitudinally extending indentation sloping inwardly at a gradual angle of from $3\frac{1}{4}$ to 5 degrees from the vertical to cause the initial deformation of said indentations to be smooth and positive;

means for inhibiting the improper insertion of said joist support within said tube including at least one medial, inwardly extending, indentation formed at the upper end of each of the two remaining opposing faces of said tube; and a rectangular base plate mounted to the bottom of said tube, the leading edge of said plate for projecting into the mine roadway being bent upwardly through an acute angle to form a lip thereby to prevent lateral displacement of said stilt and the opposite edge of said plate being extended backwards and under the body of said plate to form a raised heel thereby to cause said plate to slope at a predetermined angle relative to the horizontal mine roadway floor on which it stands thereby resisting said lateral strata movement.

* * * * *